US011566793B2

(12) United States Patent
Millius

(10) Patent No.: US 11,566,793 B2
(45) Date of Patent: Jan. 31, 2023

(54) ELECTRO-MECHANICAL ENERGY REGULATOR PROVIDING ENHANCED SIMMER PERFORMANCE

(71) Applicant: Michael J. Millius, Barrington, IL (US)

(72) Inventor: Michael J. Millius, Barrington, IL (US)

(73) Assignee: Robertshaw Controls Company, Itasca, IL (US)

( * ) Notice: Subject to any disclaimer, the term of this patent is extended or adjusted under 35 U.S.C. 154(b) by 2042 days.

(21) Appl. No.: 14/601,047

(22) Filed: Jan. 20, 2015

(65) Prior Publication Data

US 2016/0209045 A1 Jul. 21, 2016

(51) Int. Cl.
*F24C 7/08* (2006.01)
*H05B 1/02* (2006.01)

(52) U.S. Cl.
CPC ..... *F24C 7/08* (2013.01); *H05B 1/0258* (2013.01)

(58) Field of Classification Search
USPC ..... 363/106; 361/166, 3; 219/494, 491, 493, 219/519
See application file for complete search history.

(56) References Cited

U.S. PATENT DOCUMENTS 2,156,440 A * 5/1939 Veber ..... G03B 7/083 250/214 P
2,623,137 A 12/1952 Vogelsberg
2,838,646 A 6/1958 Welch
2,864,051 A * 12/1958 Hoffmann ..... H02M 1/26 361/166
2,870,290 A 1/1959 Taylor et al.
3,634,802 A 1/1972 Aldous
3,636,490 A 1/1972 Pansing
3,679,988 A * 7/1972 Haydon ..... H01H 43/024 200/37 A
3,691,404 A 9/1972 Swygert, Jr.
3,725,624 A * 4/1973 Emmons ..... A47J 43/044 366/129
3,739,226 A * 6/1973 Seiter ..... F21S 9/022 174/53
3,740,823 A * 6/1973 Watkin ..... A41H 43/00 29/429

(Continued)

FOREIGN PATENT DOCUMENTS

DE 23 56 500 A 5/1975
DE 23 64 832 A 7/1975

*Primary Examiner* — John J Norton
(74) *Attorney, Agent, or Firm* — Reinhart Boerner Van Deuren P.C.

(57) ABSTRACT

An electro-mechanical energy regulator for controlling an application of power supplied to a heating element of a cooking appliance that provides simmer operation is provided. The temperature and/or mode of operation is made via a user interface knob that is coupled to a switching control cam. This cam has an outer profile configured to drive a switching element via a power switch cam follower to close two power line contacts to power a heater. The heater drives a bimetal element whose deflection forces a temperature control switching element to close to enable power to flow to the heating element. The regulator also includes a cooking mode selector operable to open and close a pair of electrical contacts coupled in series with the heating element, and a diode coupled in parallel with the pair of electrical contacts.

20 Claims, 1 Drawing Sheet

(56) References Cited

U.S. PATENT DOCUMENTS 3,761,649 A * 9/1973 Jedynak ..... H01H 25/06 200/14
3,776,124 A * 12/1973 Morley ..... A47J 37/0611 99/335
3,789,688 A * 2/1974 Minks ..... B63H 23/30 192/142 R
3,809,862 A * 5/1974 Simmons ..... H01H 37/50 219/512
3,843,286 A * 10/1974 Horberg, Jr. ..... B29C 49/56 425/183
3,846,726 A 11/1974 Hierholzer, Jr. et al.
3,866,634 A * 2/1975 Rutkevich ..... D03C 5/02 139/79
3,878,498 A * 4/1975 Allen ..... H01H 89/04 337/347
3,905,003 A 9/1975 Rosenberg et al.
3,922,627 A * 11/1975 Shepherd ..... H01H 19/60 337/363
3,932,830 A 1/1976 Holtkamp
3,975,601 A 8/1976 Whelan
4,017,702 A * 4/1977 Harmon ..... H05B 6/666 219/715
4,053,939 A * 10/1977 Nakauchi ..... E05B 47/0603 292/144
4,133,990 A 1/1979 Wanner et al.
4,167,688 A * 9/1979 Burek ..... G08C 19/30 219/501
4,173,029 A * 10/1979 Rabindran ..... H02P 5/68 242/352.1
4,206,344 A 6/1980 Fischer et al.
4,214,151 A * 7/1980 Kicherer ..... F24C 15/106 219/457.1
4,291,965 A * 9/1981 Johnson ..... G02B 7/40 367/96
4,302,662 A * 11/1981 Kicherer ..... F24C 15/106 219/491
4,337,451 A 6/1982 Fox
4,406,217 A * 9/1983 Oota ..... A47J 31/52 219/501
RE31,597 E * 6/1984 Fischer ..... F24C 15/106 219/507
4,471,338 A * 9/1984 Holtkamp ..... H01H 3/20 337/360
4,495,387 A 1/1985 Thrush
4,600,164 A * 7/1986 Ty ..... B62M 13/04 242/385
4,704,595 A 11/1987 Essig et al.
4,772,779 A * 9/1988 Scheidler ..... H05B 3/748 219/448.11
4,788,415 A * 11/1988 Whipple, Jr. ..... F24C 15/106 219/483
4,876,564 A * 10/1989 Amikura ..... G02B 7/102 359/704
4,883,983 A 11/1989 Llewellyn et al.
4,902,877 A * 2/1990 Grasso ..... F24C 15/106 219/483
4,949,020 A 8/1990 Warren et al.
4,973,933 A * 11/1990 Kadlubowski ..... H01H 89/04 219/486
4,993,144 A 2/1991 Llewellyn et al.
5,021,762 A 6/1991 Hetrick
5,191,310 A * 3/1993 Obermann ..... H01H 89/04 337/103
5,219,070 A 6/1993 Grunert et al.
5,357,082 A * 10/1994 Higgins ..... F24C 7/082 219/445.1
5,449,959 A * 9/1995 Yang ..... G05F 1/62 307/63
5,636,618 A 6/1997 Kirstein
5,700,994 A 12/1997 Gheer et al.
5,877,670 A * 3/1999 Sehlhorst ..... H01H 61/063 337/309
6,008,608 A 12/1999 Holsten et al.
6,050,369 A * 4/2000 Leone ..... B66B 1/34 187/280
6,064,045 A * 5/2000 Reichert ..... H01H 37/26 219/507
6,078,169 A 6/2000 Petersen
6,080,972 A * 6/2000 May ..... A21B 1/02 219/486
6,191,391 B1 * 2/2001 Deo ..... F24C 15/18 126/273 R
6,314,240 B1 * 11/2001 Okawara ..... G02B 7/102 396/81
6,953,915 B2 10/2005 Garris, III
7,208,704 B1 * 4/2007 Couts ..... H05B 1/0266 219/491
8,274,231 B2 * 9/2012 Yang ..... H05B 33/083 307/31

* cited by examiner

ELECTRO-MECHANICAL ENERGY REGULATOR PROVIDING ENHANCED SIMMER PERFORMANCE

FIELD OF THE INVENTION

This invention generally relates to electro-mechanical energy regulators or infinite switches for use in cooking appliance control, and more particularly to electro-mechanical energy regulators or infinite switches providing simmer modes of operation.

BACKGROUND OF THE INVENTION

The use of infinite switch energy regulators are well known in the art of energy and load control. For example, infinite switch energy regulators are employed in electric ranges, to control the energy supplied to a load, such as a burner. In a typical infinite switch energy regulator, depending on the setting of the switch, a duty cycle is selected to be provided as an output from the energy regulator to the load. An infinite switching type energy regulator works on the principle that if the contacts are opened and closed at different on-to-off time ratios, or different duty cycles, sometimes referred to as % (percent) on-times, the energy transmitted to a physical mass, through an electrical load, can be regulated as those ratios are varied. However, in order to regulate the temperature of the heating element to which the electrical power is supplied, the on/off switching of electrical energy requires that the cooktop heating element (load) and physical mass in contact with the heating element, such as a pot or pan with water or food, have a significant lumped thermal capacitance.

An infinite switching type energy regulator typically has a bimetal element coupled to a cycling contact and an internal heater that causes the bimetal element to deform when energy is applied to the internal heater and the resistive load. As the load and the internal heater are heated, the bimetal element deforms and the switch is opened. The cycling contact closes, due to spring forces, after the bimetal has cooled sufficiently to allow it to deform back to its original ambient temperature shape. An infinite switch energy regulator is typically employed in a 240 volt ac application and the internal heater and collaboration are configured for use in such an application.

One of the problems with the presently available energy regulator is that, due to various factors including mechanical tolerances, infinite switches typically have trouble maintaining consistent low duty cycle performance as is required for simmer cooking cycles. This is because the duty cycle effect is produced by the bimetal material in combination with the internal heater. As this duty cycle is reduced to low settings, which is necessary for the simmer of delicate foods/ingredients, changes to the mechanical tolerances over time can cause issues for performance. It is not uncommon for such changes to result in 2% changes in the cycle time.

However, a low duty cycle setting for simmer operation might only be 2% to 9% (~5% average) as part of a 30-90 cycle time for a typical appliance. Even though the infinite switch may calibrate correctly at 2% upon its initial build, changes to components over time, including wear and deformation, can cause this same infinite switch to stop cycling with only a 2% shift in component switching performance. This would result in a loss of simmer control for very delicate sauces and other foods. What is needed, therefore, is an infinite switch controller for a cooking appliance that provides lower duty cycle operational calibrations to allow for more consistent operation over time as changes to the operative components occur.

Embodiments of the present invention provide such electro-mechanical energy regulators, or infinite switches, for use with a cooking appliance to provide enhanced simmer control over time. These and other advantages of the invention, as well as additional inventive features, will be apparent from the description of embodiments of the invention provided herein.

BRIEF SUMMARY OF THE INVENTION

In view of the above, embodiments of the present invention provide a new and improved electro-mechanical energy regulator, also known as an infinite switch in the appliance industry, that overcomes one or more of the above issues. More particularly, embodiments of the present invention provide a new and improved infinite switch that provides enhanced simmer cooking performance. Still more particularly, embodiments of the present invention provide new and improved infinite switches that provide enhanced simmer cooking performance over time as component variations occur.

In one embodiment of the present invention, an auxiliary contact and diode are included with the infinite switch. Preferably, the auxiliary switch is positioned in series with the cycling switch contact controlled by the bimetal element. In such embodiment, the diode is coupled in parallel with the auxiliary switch. In normal cooking modes of operation, i.e. in non-simmer modes, the auxiliary switch is maintained in the closed position to short out the diode. However, in simmer mode the auxiliary switch is opened. The diode then provides half-wave power flow to the heating element of the appliance when the cycling switch is closed.

In such a preferred embodiment utilizing an auxiliary switch with diode rectification, lower duty cycles can be calibrated, e.g., 1%-4.5%, or the same duty cycles can be held more consistently over time. For example, with half wave power flow to the heating element, a 2% duty cycle would be the mechanical equivalent to a 4% duty cycle with the prior infinite switch. Because of this, a 2% shift would only cause the infinite switch of the preferred embodiment of the present invention to change from 2% to 1%, instead of 2% to 0% with the prior infinite switch. In applications where the component drift issues are not significant, then the enhanced lower duty cycle performance of 1% to 4.5% duty cycle allows for a greater precision of adjustment.

In one embodiment of the present invention, an improvement to an electro-mechanical energy regulator for controlling an application of power supplied to a heating element of a cooking appliance is provided. The application of power via the regulator is preferably based on a user selection of a temperature and/or mode of operation via a user interface knob that is coupled to a switching control cam. This cam has an outer profile that is configured to drive a switching element via a power switch cam follower to close two power line contacts. Once closed, a heater is powered to drive a bimetal element whose deflection resulting from heating thereof forces a temperature control switching element to close to enable power to flow to the heating element. A cooking mode selector that is operable to open and close a pair of electrical contacts coupled in series with the heating element is then provided, along with a diode that is coupled in parallel with the pair of electrical contacts to improve the simmer performance as will be discussed in detail herein.

In one embodiment the cooking mode selector is an auxiliary switch control cam, and the position of the pair of electrical contacts is controlled via an auxiliary switch cam follower that is coupled to the auxiliary switch control cam. Preferably, an outer surface of the auxiliary switch control cam is configured to cause the auxiliary switch cam follower to close the pair of electrical contacts during normal cooking modes and to cause the auxiliary switch cam follower to open the pair of electoral contacts during simmer cooking modes. The diode is shorted out by the pair of electrical contacts to allow full wave power flow to the heating element during normal cooking modes, and is not shorted out to allow only half wave power flow to the heating element during simmer cooking modes.

In an embodiment of the present invention, the auxiliary switch control cam is operatively coupled to the switching control cam such that rotation of the user interface knob also operates to rotate the auxiliary switch control cam. In an embodiment, the auxiliary switch control cam and the switching control cam are a single cam having at least two cam tracks, one of the at least two cam tracks operatively coupled to the power switch cam follower and another of the at least two cam tracks operatively coupled to the auxiliary switch cam follower. Alternatively, the auxiliary switch control cam and the switching control cam are a single cam having a single cam track operable to control both the power switch cam follower and the auxiliary switch cam follower. In another embodiment, the cooking mode selector is a push button operable to close the auxiliary switch contacts upon user activation of the push button.

In one embodiment of the present invention, an electric power controller for controlling a cooking temperature of a heating element of a cooking appliance is provided. The controller includes an infinite switch having a pair of electrical inputs and a pair of electrical outputs configured to control a duty cycle of power application to the heating element in both a cooking and a simmer mode of operation. The controller also includes a pair of electrical contacts coupled in series with one of the pair of electrical outputs of the infinite switch and the heating element, and a diode coupled in parallel with the pair of electrical contacts.

Preferably, the infinite switch includes a user rotatable switching control cam having an outer profile configured to drive a switching element via a power switch cam follower to close two power line contacts to power a heater to drive a bimetal element whose deflection resulting from heating thereof forces a temperature control switching element to close to enable power to flow between the pair of electrical outputs to the heating element. The cooking mode selector is an auxiliary switch control cam in one embodiment, and the position of the pair of electrical contacts is controlled via an auxiliary switch cam follower operatively coupled to the auxiliary switch control cam. The outer surface of the auxiliary switch control cam is configured to cause the auxiliary switch cam follower to close the pair of electrical contacts during normal cooking modes and to cause the auxiliary switch cam follower to open the pair of electoral contacts during simmer cooking modes.

In one embodiment, the diode is shorted out by the pair of electrical contacts to allow full wave power flow to the heating element during normal cooking modes, and allows only half wave power flow to the heating element during simmer cooking modes.

In yet another embodiment of the present invention an electro-mechanical energy regulator is provided that includes a first electrical input coupled to a first power line contact, and a first electrical output coupled to a second power line contact. The first electrical output is configured to be coupled to a first contact of an electrical load. A rotatable power switch cam that operably coupled to a first cam follower to open and close a first connection between the first power line contact and the second power line contact is also included, as is a second electrical input coupled to a third power line contact, a fourth power line contact coupled to a first auxiliary contact, a second electrical output coupled to a second auxiliary contact, the second electrical output configured to be coupled to a second contact of the electrical load, a diode electrically coupled between the first auxiliary contact and the second electrical output, and a rotatable auxiliary switch control cam operably coupled to an auxiliary switch control cam follower to open and close a second connection between the first auxiliary contact and the second auxiliary contact. In this embodiment the power switch cam and the auxiliary switch control cam are operably coupled together, and a third electrical connection between the third and fourth electrical contacts is controlled by a bimetal element and a heater that is energized when the first power line contact and the second power line contact are closed.

Preferably, the first and the second auxiliary contacts are closed during a cooking mode of operation to enable bidirectional power flow between the first and the second electrical outputs. Still more preferably, the first and the second auxiliary contacts are open during a simmer mode of operation to enable unidirectional power flow between the first and the second electrical outputs.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
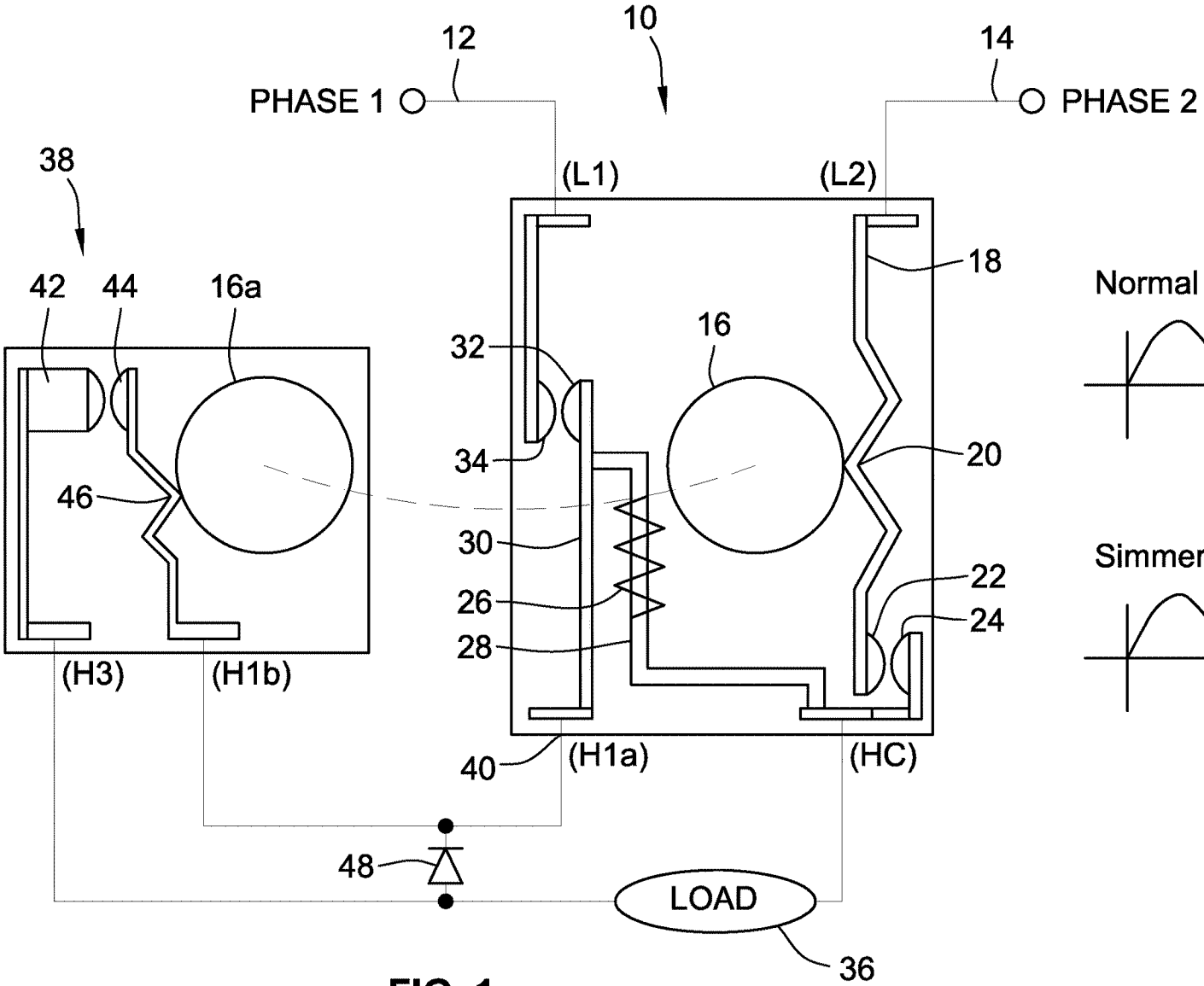
FIG. 1 is a simplified schematic representation of an embodiment of an electro-mechanical energy regulator, or infinite switch, used in a cooking appliance to provide enhanced, long term, simmer performance.

Turing now to the drawings, there is illustrated in FIG. 1 a simplified schematic diagram of an embodiment of the electro-mechanical energy regulator, also known as an infinite switch 10, constructed in accordance with the teachings of the present invention. It should be noted that while the following description will describe such embodiment in the context of a cooking appliance, such description should be taken by way of example and not by way of limitation. Also, such description will describe the representative embodiment shown in the drawings in the context of the functional operation and construction thereof, but should not be taken as limiting such functional operation or construction to that shown in the illustrated embodiment.

As shown in FIG. 1, the infinite switch 10 is utilized in a cooking appliance as a control mechanism for application and control of power from two power phase lines 12, 14 of the input line power from the utility for 240 volt operation. This application of power is based on a user selection of a temperature and/or mode of operation via a user interface knob that is coupled to a cam 16. As the cam 16 is rotated, its outer profile will drive switching element 18 via its cam follower 20 to close contacts 22, 24. Once closed, power from power phase line 14 is available to the heater 26 to drive the bimetal element 28. Deflection of the bimetal element 28 resulting from the heating thereof will force switching element 30 to close contacts 32, 34. When both of the contact sets 22, 24 and 32, 34 are closed, the heating element load 36 is energized, as will be discussed in the various modes more fully below, to heat the food to be cooked thereon.

As will be recognized by those skilled in the art familiar with infinite switches in the appliance industry, e.g., the M Series energy regulators available from Robertshaw Controls Company of Carol Stream, Ill., the control of the heater 26 to vary the duty cycle of the switching of contacts 32, 34 provides the different cooking temperature settings that correspond with the rotational position of the user knob and cam 16. Therefore, a description of such operation is foregone herein in the interest of focusing on the novel and non-obvious advances over such conventional infinite switch operation.

The rotational position of the knob and cam 16 also controls the cooking mode, e.g., simmer or normal temperature control as is also known. However, unlike conventional infinite switch configuration and operation, the embodiment of the present invention illustrated in FIG. 1 includes an auxiliary switching element 38 interposed between the output 40 and load 36. A diode 48 is connected in parallel with the auxiliary switch 38.

The condition of the auxiliary switching element 38, i.e. whether contacts 42, 44 are opened or closed, is controlled by the rotational position of cam 16A via cam follower 46. As illustrated by dashed line connecting cam 16 and cam 16A, in one embodiment of the present invention rotation of the knob and cam 16 by the user also operates to rotate cam 16A. In other embodiments, cam 16 and cam 16A may be embodied as a single cam having multiple cam tracks for cam followers 20, 46, or a single cam track operable to control both cam followers 20, 46. In yet other embodiments, operation of auxiliary switch 38 may be via a push button operable to close contacts 42, 44 upon user activation of a delicate simmer mode via the push button.

Figure 2:
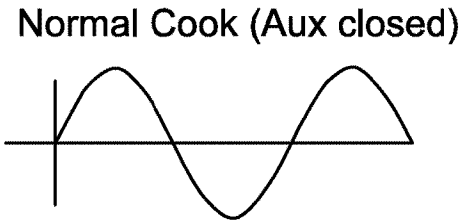
FIG. 2 is a voltage waveform diagram illustrating normal cooking cycle, i.e. non-simmer, performance of the infinite switch of FIG. 1.

In normal cooking modes of operation, the contacts 42, 44 of the auxiliary switch 38 are closed in order to allow control over the power flow to load 36 to be accomplished directly by the opening and closing of contacts 32, 34 by the heater 26 as in a conventional infinite switch. When the contacts 32, 34 are closed, the voltage supplied to the load 36 is the normal full wave supplied between the two phases 12, 14 of the utility power as shown in FIG. 2. This full wave power is supplied to the load 36 until the bimetal element 28 causes the contacts 32, 34 to open at the end of the heating duty cycle period. The percent on-time of such heating cycle is varied via the position of the know and cam 16 as is known in the art to vary the cooking temperature.

Once the user activates the simmer mode of operation, via rotation of the knob and cams 16, 16A in the embodiment shown in FIG. 1, the cam follower 46 causes contacts 42, 44 to open due to the profile of the cam 16A. The length of the reduced radius arc of cam 16A allowing the cam follower 46 to open contacts 42, 44 corresponds to the various selectable temperatures in the simmer mode, and may vary depending on the design of the particular appliance. In other embodiments, the length may extend over only a portion of the simmer mode, preferably over the delicate simmering temperatures at the lower end of the on-time duty cycles available.

Figure 3:
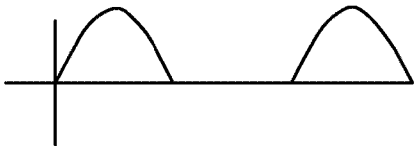
FIG. 3 is a voltage waveform diagram illustrating simmer cooking cycle performance of the infinite switch of FIG. 1.

When contacts 42, 44 are opened in such a simmer mode of operation, power flow to the load 36 through contacts 32, 34 is subject to operation of diode 48. This diode 48 is normally shorted out by contacts 42, 44 during normal cooking modes, thereby allowing full wave power flow to the load 36 as shown in FIG. 2 discussed above. However, in the simmer modes when contacts 42, 44 are open, only half wave power flow to the load 36 as shown in FIG. 3 is allowed. As the voltage between the two phases 14, 12 goes negative, diode 48 operates to block current flow from one phase 12 to the other phase 14, resulting in half wave power being applied to load 36.

In such an embodiment lower duty cycles can be calibrated, e.g., 1%-4.5%, with the same mechanical switching of contacts 32, 34 as the conventional infinite switch, e.g. 2%-9%. This is because the power to the load 36 is halved via operation of diode 48. Alternatively or additionally, the same duty cycles in terms of power delivered can be held more consistently over time. That is, with half wave power flow to the heating element load 36, a 2% duty cycle power would be the mechanical equivalent to a 4% duty cycle switching with the prior infinite switch. Because of this, a 2% shift over time due to changes in the mechanical tolerance variations would only cause the infinite switch of the embodiment of FIG. 1 to change from 2% to 1% duty cycle power flow, instead of 2% to 0% with the prior infinite switch. In other words, the provision of half wave power during simmer operation allows for calibration at twice the on-time percentage to achieve the same simmer temperature performance, and therefore, a 2% tolerance shift over time continues to allow switching control operation whereas the prior infinite switches stopped switching altogether. In applications where the component drift issues are not significant, then the enhanced lower duty cycle performance of 1% to 4.5% duty cycle allows for a greater precision of adjustment of simmer temperature.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electro-mechanical energy regulator for controlling an application of power supplied to a heating element of a cooking appliance based on a user selection of a temperature and/or mode of operation via a user interface knob that is coupled to a switching control cam having an outer profile configured to drive a switching element via a power switch cam follower to close two power line contacts to power a heater to drive a bimetal element whose deflection resulting from heating thereof forces a temperature control switching element to close to enable power to flow to the heating element, comprising:

a cooking mode selector operable to open and close a pair of electrical contacts coupled in series with the heating element; and a diode coupled in parallel with the pair of electrical contacts.

2. The regulator of claim 1, wherein the cooking mode selector is an auxiliary switch control cam, and wherein a position of the pair of electrical contacts is controlled via an auxiliary switch cam follower operatively coupled to the auxiliary switch control cam.

3. The regulator of claim 2, wherein an outer surface of the auxiliary switch control cam is configured to cause the auxiliary switch cam follower to close the pair of electrical contacts during normal cooking modes and to cause the auxiliary switch cam follower to open the pair of electrical contacts during simmer cooking modes.

4. The regulator of claim 3, wherein the diode is shorted out by the pair of electrical contacts to allow full wave power flow to the heating element during the normal cooking modes, and wherein the diode allows only half wave power flow to the heating element during the simmer cooking modes.

5. The regulator of claim 2, wherein the auxiliary switch control cam is operatively coupled to the switching control cam such that rotation of the user interface knob also operates to rotate the auxiliary switch control cam.

6. The regulator of claim 5, wherein the auxiliary switch control cam and the switching control cam are a single cam having at least two cam tracks, one of the at least two cam tracks operatively coupled to the power switch cam follower and another of the at least two cam tracks operatively coupled to the auxiliary switch cam follower.

7. The regulator of claim 5, wherein the auxiliary switch control cam and the switching control cam are a single cam having a single cam track operable to control both the power switch cam follower and the auxiliary switch cam follower.

8. The regulator of claim 1, wherein the cooking mode selector is a push button operable to close the auxiliary switch contacts upon user activation of the push button.

9. An electric power controller for controlling a cooking temperature of a heating element of a cooking appliance, comprising:

an infinite switch having a pair of electrical inputs and a pair of electrical outputs configured to control a duty cycle of power application to the heating element in both a cooking and a simmer mode of operation;

a pair of electrical contacts coupled in series with one of the pair of electrical outputs of the infinite switch and the heating element; and a diode coupled in parallel with the pair of electrical contacts.

10. The controller of claim 9, wherein the infinite switch includes a user rotatable switching control cam having an outer profile configured to drive a switching element via a power switch cam follower to close two power line contacts to power a heater to drive a bimetal element whose deflection resulting from heating thereof forces a temperature control switching element to close to enable power to flow between the pair of electrical outputs to the heating element.

11. The controller of claim 10, wherein the infinite switch includes an auxiliary switch control cam, and wherein a position of the pair of electrical contacts is controlled via an auxiliary switch cam follower operatively coupled to the auxiliary switch control cam.

12. The controller of claim 11, wherein an outer surface of the auxiliary switch control cam is configured to cause the auxiliary switch cam follower to close the pair of electrical contacts during normal cooking modes and to cause the auxiliary switch cam follower to open the pair of electoral contacts during simmer cooking modes.

13. The controller of claim 12, wherein the diode is shorted out by the pair of electrical contacts to allow full wave power flow to the heating element during the normal cooking modes, and wherein the diode allows only half wave power flow to the heating element during the simmer cooking modes.

14. The controller of claim 11, wherein the auxiliary switch control cam is operatively coupled to the user rotatable switching control cam such that rotation of the user interface knob also operates to rotate the auxiliary switch control cam.

15. The controller of claim 14, wherein the auxiliary switch control cam and the user rotatable switching control cam are a single cam having at least two cam tracks, one of the at least two cam tracks operatively coupled to the power switch cam follower and another of the at least two cam tracks operatively coupled to the auxiliary switch cam follower.

16. The controller of claim 14, wherein the auxiliary switch control cam and the user rotatable switching control cam are a single cam having a single cam track operable to control both the power switch cam follower and the auxiliary switch cam follower.

17. The controller of claim 10, wherein the infinite switch includes a push button operable to close the pair of electrical contacts upon user activation of the push button.

18. An electro-mechanical energy regulator, comprising:

a first electrical input coupled to a first power line contact;

a first electrical output coupled to a second power line contact, the first electrical output configured to be coupled to a first contact of an electrical load;

a rotatable power switch cam operably coupled to a first cam follower to open and close a first connection between the first power line contact and the second power line contact;

a second electrical input coupled to a third power line contact;

a fourth power line contact coupled to a first auxiliary contact;

a second electrical output coupled to a second auxiliary contact, the second electrical output configured to be coupled to a second contact of the electrical load;

a diode electrically coupled between the first auxiliary contact and the second electrical output;

a rotatable auxiliary switch control cam operably coupled to an auxiliary switch control cam follower to open and close a second connection between the first auxiliary contact and the second auxiliary contact;

wherein the rotatable power switch cam and the rotatable auxiliary switch control cam are operably coupled together; and wherein a third electrical connection between the third and fourth power line electrical contacts is controlled by a bimetal element and a heater that is energized when the first power line contact and the second power line contact are closed.

19. The regulator of claim 18, wherein the first and the second auxiliary contacts are closed during a cooking mode of operation to enable bidirectional power flow between the first and the second electrical outputs.

20. The regulator of claim 18, wherein the first and the second auxiliary contacts are open during a simmer mode of operation to enable unidirectional power flow between the first and the second electrical outputs.

* * * * *